US005463998A

United States Patent [19]

Denz et al.

[11] Patent Number: 5,463,998

[45] Date of Patent: Nov. 7, 1995

[54] METHOD AND ARRANGEMENT FOR CHECKING THE OPERABILITY OF A TANK-VENTING SYSTEM

[75] Inventors: Helmut Denz, Stuttgart; Andreas Blumenstock, Ludwigsburg, both of Germany

[73] Assignee: Robert Bosch GmbH, Stuttgart, Germany

[21] Appl. No.: 129,039

[22] PCT Filed: Jan. 14, 1993

[86] PCT No.: PCT/DE93/00019

§ 371 Date: Oct. 4, 1993

§ 102(e) Date: Oct. 4, 1993

[87] PCT Pub. No.: WO93/15313

PCT Pub. Date: Aug. 5, 1995

[30] Foreign Application Priority Data

Feb. 4, 1992 [DE] Germany ..... 42 03 100.1

[51] Int. Cl.[6] ..... F02M 33/02

[52] U.S. Cl. ..... 123/520; 123/198 D

[58] Field of Search ..... 123/520, 519, 123/521, 518, 516, 198 D

[56] References Cited

U.S. PATENT DOCUMENTS

| | | | |
|---|---|---|---|
| 5,193,512 | 3/1993 | Steinbrenner et al. . | |
| 5,205,263 | 4/1993 | Blumenstock et al. . | |
| 5,275,144 | 1/1994 | Gross | 123/520 |
| 5,295,472 | 3/1994 | Otsuka | 123/520 |
| 5,299,545 | 4/1994 | Kuroda | 123/198 D |
| 5,327,873 | 7/1994 | Ohuchi | 123/198 D |
| 5,339,788 | 8/1994 | Blumenstock | 123/520 |
| 5,355,863 | 10/1994 | Yamanaka | 123/520 |
| 5,363,828 | 11/1994 | Yamashita | 123/520 |

FOREIGN PATENT DOCUMENTS

| | | | |
|---|---|---|---|
| 4030948 | 10/1991 | Germany . | |
| 4153554 | 5/1992 | Japan | 123/519 |
| 5180100 | 7/1993 | Japan | 123/519 |
| 6042412 | 2/1994 | Japan | 123/519 |
| 6159158 | 6/1994 | Japan | 123/519 |
| 2254318 | 10/1992 | United Kingdom . | |

*Primary Examiner*—Carl S. Miller
*Attorney, Agent, or Firm*—Walter Ottesen

[57] ABSTRACT

A method for checking the operability of a tank-venting system in a vehicle having an internal combustion engine, which tank-venting system has a tank with a tank-pressure sensor, an adsorption filter connected to the tank via a tank-connecting line, and a tank-venting valve which is connected to the adsorption filter via a valve line, in which system the adsorption filter has a venting line which can be closed with the aid of a shut-off valve, has the following steps:

closing the shut-off valve;

opening the tank-venting valve;

determining the build-up gradient (p+) of the underpressure building up in the tank;

closing the tank-venting valve;

determining the decay gradient (p–) of the decaying underpressure in the tank;

mathematically combining the build-up and decay gradients in a manner such that the influence of the fill level has as little effect as possible on the evaluation variable (Q) formed by means of the combination; and, comparing the value of the evaluation variable with a threshold value (Q_SW) and evaluating the system as non-operative if the value of the evaluation variable and the threshold value fulfill a pregiven relationship.

8 Claims, 5 Drawing Sheets

METHOD AND ARRANGEMENT FOR CHECKING THE OPERABILITY OF A TANK-VENTING SYSTEM

FIELD OF THE INVENTION

The following description relates to a method and an arrangement for checking the operability of a tank-venting system on a vehicle having an internal combustion engine.

BACKGROUND OF THE INVENTION

U.S. Pat. No. 5,193,512 discloses a tank-venting system which has a tank with a tank-pressure sensor, an adsorption filter connected to the tank via a tank-connecting line, and a tank-venting valve which is connected to the adsorption filter via a valve line, in which system the adsorption filter has a venting line which can be closed by means of a shut-off valve. The tank-venting system configured in this way is checked for operability by the following method:

checking to determine whether an operating state is present, for example full load, in which no significant underpressure can build up in the tank after the closure of the shut-off valve and the opening of the tank-venting valve;

if such a state is present, the method is terminated; otherwise, the following steps follow:

closing the shut-off valve;

opening the tank-venting valve;

measuring of the underpressure building up in the tank; and, evaluating of the tank-venting system as non-operative if a pregiven underpressure is not reached.

U.S. Pat. No. 5,205,263 discloses a method which operates on a tank-venting system without a shut-off valve and has the following method steps:

opening the tank-venting valve;

determining the build-up gradient of the underpressure building up in the tank; and, comparing the build-up gradient and/or the decay gradient with a respective threshold value and evaluation of the system as operative if the at least one gradient and the corresponding threshold value fulfill a pregiven relationship.

U.S. patent application Ser. No. 08/070,334, filed May 26, 1993, discloses a similar method which is however carried out on a tank-venting system with a shut-off valve. Measurements for determining the build-up and the decay gradient are only taken into account once it has been ensured that the measurements are not influenced by vaporizing fuel. For this purpose, a leanness correction check is used with the aid of a lambda controller and/or a check as to whether the vehicle and hence also the contents of the tank are presumably in motion.

It has been shown that the known and proposed methods require further refinement in order to be able to detect small leaks in the order of 2 mm.

SUMMARY OF THE INVENTION

The method according to the invention for checking the operability of a tank-venting system of the kind mentioned above has the following steps:

closing the shut-off valve;

opening the tank-venting valve;

determining the build-up gradient of the underpressure building up in the tank;

closing the tank-venting valve;

determining the decay gradient of the decaying underpressure in the tank;

mathematically combining the build-up and decay gradients in such a manner that the influence of the fill level has as little effect as possible on the evaluation variable formed by the combination;

comparing the value of the evaluation variable to a threshold value and evaluating the system as non-operative if the value of the evaluation variable and the threshold value fulfill a pregiven relationship.

The arrangement according to the invention has a sequence controller for driving the shut-off valve and the tank-venting valve; a gradient determination device for determining the above-mentioned gradients; an evaluation-variable formation device for forming the above-mentioned quotient and a comparison/evaluation device for carrying out the above-mentioned comparison and the corresponding evaluation.

It is noted that when reference is made below to gradients of the underpressure build up or decay, almost always positive (absolute) values (in terms of magnitude) are meant. Only FIGS. 2*a* and 2*b* relate to these gradients with reference to the sign.

It has been shown that the method according to the invention provides evaluation results which are hardly influenced by the fill level of the tank. If the tank is almost full, both gradients are relatively high, while, in the case of an almost empty tank, they are both relatively low. The relative changes in both gradients as a function of the fill level of the tank depend essentially, in the same way, on the fill level so that quotient formation essentially eliminates the effects exerted on the gradients by the fill level.

In a preferred embodiment, the quotient of the decay gradient and the build-up gradient is formed and the system is determined to be non-operative if the quotient is greater than the mentioned threshold value. If there is a leak in the system, the decay gradient is relatively large and the build-up gradient relatively small, as a result of which the quotient rises above the threshold value. If the system is clogged, the build-up gradient is very small, whereas there is no particular effect on the decay gradient so that the quotient likewise rises above the threshold value due to the small denominator.

The method is theoretically most precise if it is carried out when the vehicle is at standstill and the fuel vaporized. Vaporizing of the fuel, whether it be due to an elevated temperature or due to movements of the tank content, influences the gradients in the same way as a leak and thus falsifies the measurement. If the method is carried out on an internal combustion engine having a lambda controller, it is a simple matter, with the aid of a conventional leanness correction check to ascertain whether the fuel is vaporizing during the build-up of the underpressure. It has been shown that the determination of the gradients is not significantly influenced by vaporizing fuel even if vaporizing can already be clearly ascertained at the stage of the leanness correction check, for example, from a correction in the region of 5 to 10%. The checking method according to the invention is therefore preferably further developed in such a way that a leanness correction check is carried out and the check is terminated if the leanness correction to be carried out is greater than a threshold leanness correction.

During the decay of the underpressure, a leanness correction check is not possible since the tank-venting valve is closed. If, however, during the underpressure build-up no leanness correction has been necessary and the vehicle is at standstill during decay, it is improbable that the fuel is vaporizing. The fact that the vehicle is at standstill is therefore measured directly by means of appropriate signals, for example, speed or acceleration measurement, or a conclusion as to driving is drawn indirectly, for example, from load signals or clutch/transmission-position signals. It is, however, also possible, immediately following the last measurement for the determination of the decay gradient, to open the tank-venting valve again and check whether a leanness correction is necessary. If this is not the case, the conclusion is drawn that the decay gradient has not been influenced by vaporizing fuel. However, the possibility that the tank pressure has been influenced by increases and reductions in volume due to the sloshing of fuel cannot be excluded. However, such fluctuations cancel each other out on average over time and can accordingly be taken into account by time averaging the pressure measured for determining the decay gradient.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
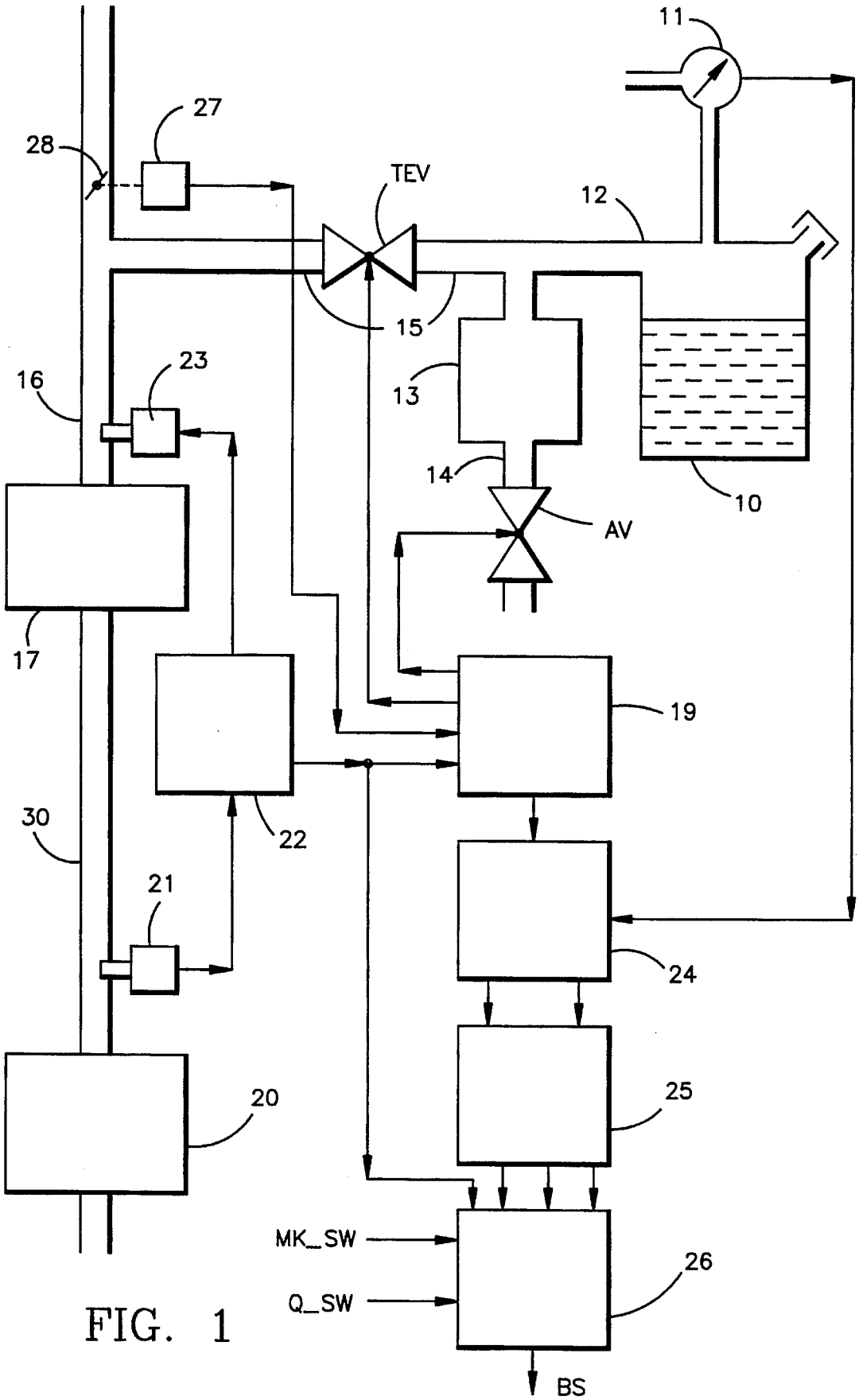
FIG. 1 is a block diagram of a tank-venting system having an arrangement for checking the operability of the system by evaluating a quotient (decay gradient/build-up gradient) relating to the underpressure in the tank.

The tank-venting system shown in FIG. 1 inter alia has a tank 10 having a differential pressure sensor 11, an adsorption filter 13 connected to the tank via a tank-connecting line 12 and having a venting line 14 with a shut-off valve AV mounted therein and a tank-venting valve TEV, which is mounted in a valve line 15 which connects the adsorption filter 13 to the intake pipe 16 of an internal combustion engine 17. The tank-venting valve TEV and the shut-off valve AV are driven by signals such as those outputted by a sequence control block 19. The tank-venting valve TEV is also driven in dependence upon the operating state of the engine 17 although this is not shown in FIG. 1.

A catalytic converter 20 is arranged in the exhaust-gas channel 30 of the engine 17 with a lambda probe 21 located forward of the catalytic converter. This lambda probe 21 transmits its signal to a lambda-control block 22 which, from this signal, determines a positioning signal for an injection device 23 in the intake pipe 16 and furthermore outputs a leanness correction signal MK.

An evaluation of the operability of the tank-venting system takes place with the aid of a gradient determination block 24, a quotient calculation block 25 and a comparison/evaluation block 26.

The sequence controller 19 starts a sequence for checking the operability of the tank-venting system as soon as an idle-speed signal transmitter 27 coacting with the throttle flap 28 of the engine indicates idling and an adaptation phase has ended. Adaptation phases for obtaining learning processes in the lambda-control block 22 alternate with tank-venting phases; the former typically take 1.5 min, the latter take 4 min. The sequence controller then closes the shut-off valve AV and opens the tank-venting valve TEV in the manner permissible within the context of a conventional tank-venting system; at the same time, the sequence controller starts a sequence (to be carried out by the gradient determination block 24) for determining the build-up of the underpressure in the tank 10. As soon as this gradient has been determined, the sequence controller 19 closes the tank-venting valve TEV and causes the gradient determination block 24 to determine the decay gradient for the underpressure in the tank. As soon as both gradients have been determined, the quotient of decay gradient/build-up gradient is calculated in the quotient calculation block 25, and this quotient is compared in the comparison/evaluation block 26 to a quotient threshold value Q_SW. If the quotient lies above the threshold value, an evaluation signal BS is emitted, indicating that the system is non-operative. This signal can also be emitted if the detected leanness correction is less than a threshold leanness correction and the build-up gradient is less than the threshold value.

Figure 2A:
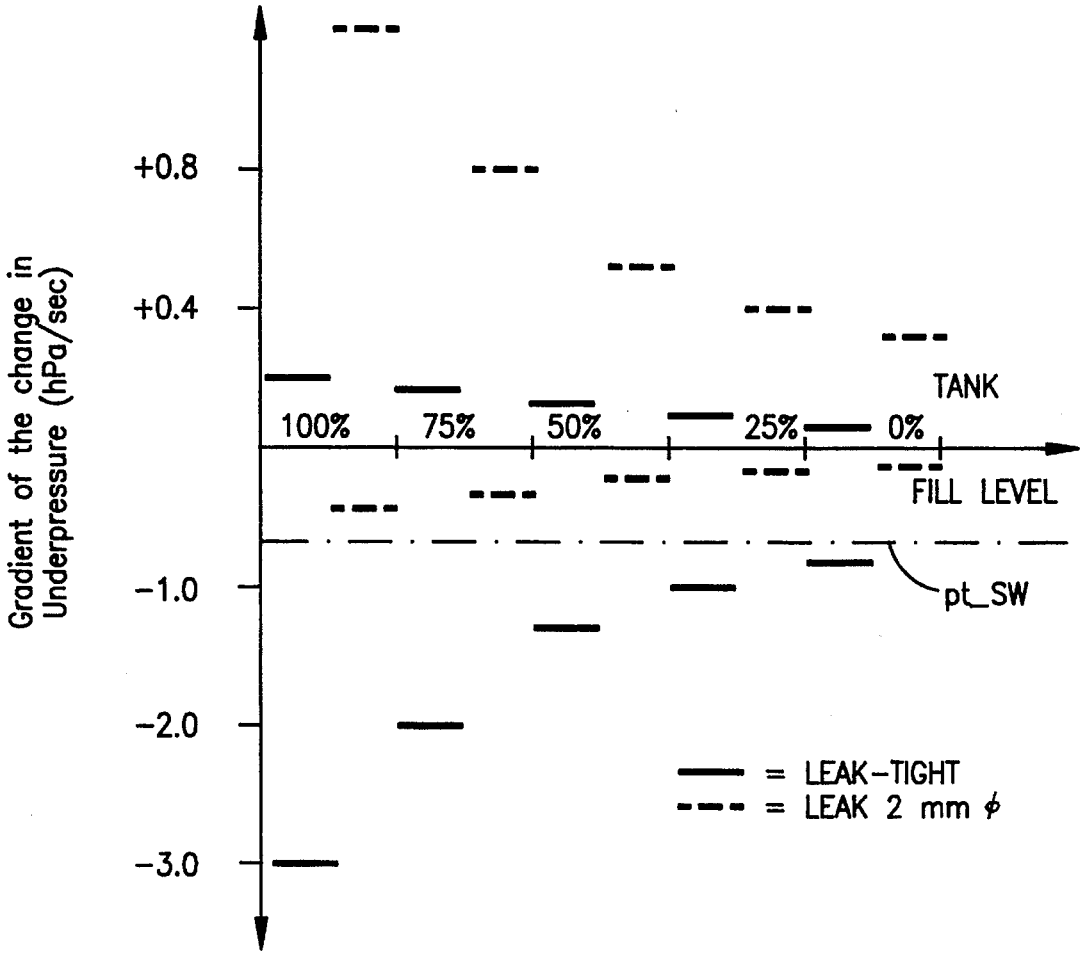
FIGS. 2*a* and 2*b* are diagrams relating to the underpressure-change gradients or quotients of the change gradients in dependence upon various tank-fill levels.
Figure 2B:
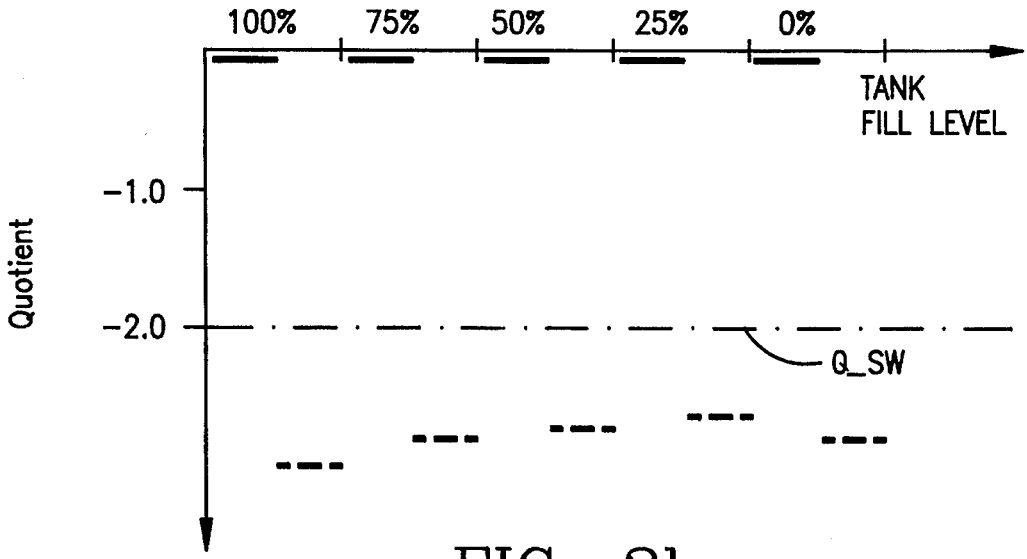

The diagram in FIG. 2*a* illustrates underpressure-change gradients measured at different fill levels of a tank of 80 liter capacity on a 2.5 liter six-cylinder engine during idling with the tank-venting valve 50% open (throughput about 0.6 $m^3/h$). For each fill level, two pairs of measured values are plotted, each with short lines. The solid lines relate to measurements for the pressure decay gradient (top) and the pressure build-up gradient (bottom) for an operative tank-venting system, while the dashed lines represent the corresponding values for a system having a leak measuring 2 mm in diameter. FIG. 2*b* shows the quotient of the decay gradient/build-up gradient for each gradient pair of FIG. 2*a*. From the figures, the following can be seen inter alia. Even with an empty tank, the build-up gradient in a leak-tight system is still clearly greater than the build-up gradient in a full system which, however, has a leak measuring 2 mm in diameter. It is therefore possible to specify a threshold value $\dot{p}$+_SW. When there is a drop below this threshold value, this clearly indicates that there is a leak of at least 2 mm in diameter. If the leak is smaller, further information is provided by the quotient represented in FIG. 2*b*. As can be seen, the quotient is virtually independent of the fill level. The value which is obtained with the leak-tight system differs very markedly from that for the system with the leak measuring 2 mm in diameter. It is therefore possible to specify a threshold value Q_SW for the quotient which is as close as possible below the smallest quotient for a leak-tight system and which accordingly makes it possible to distinguish between a leak-tight system and one with a small leak.

While a method for checking the operability of the tank-venting system has been discussed in general terms above with reference to the block diagram of FIG. 1 and the diagram in FIGS. 2*a* and 2*b*, a sequence will now be explained in greater detail with reference to the flowchart in FIGS. 3*a* and 3*b*.

Figure 3A:
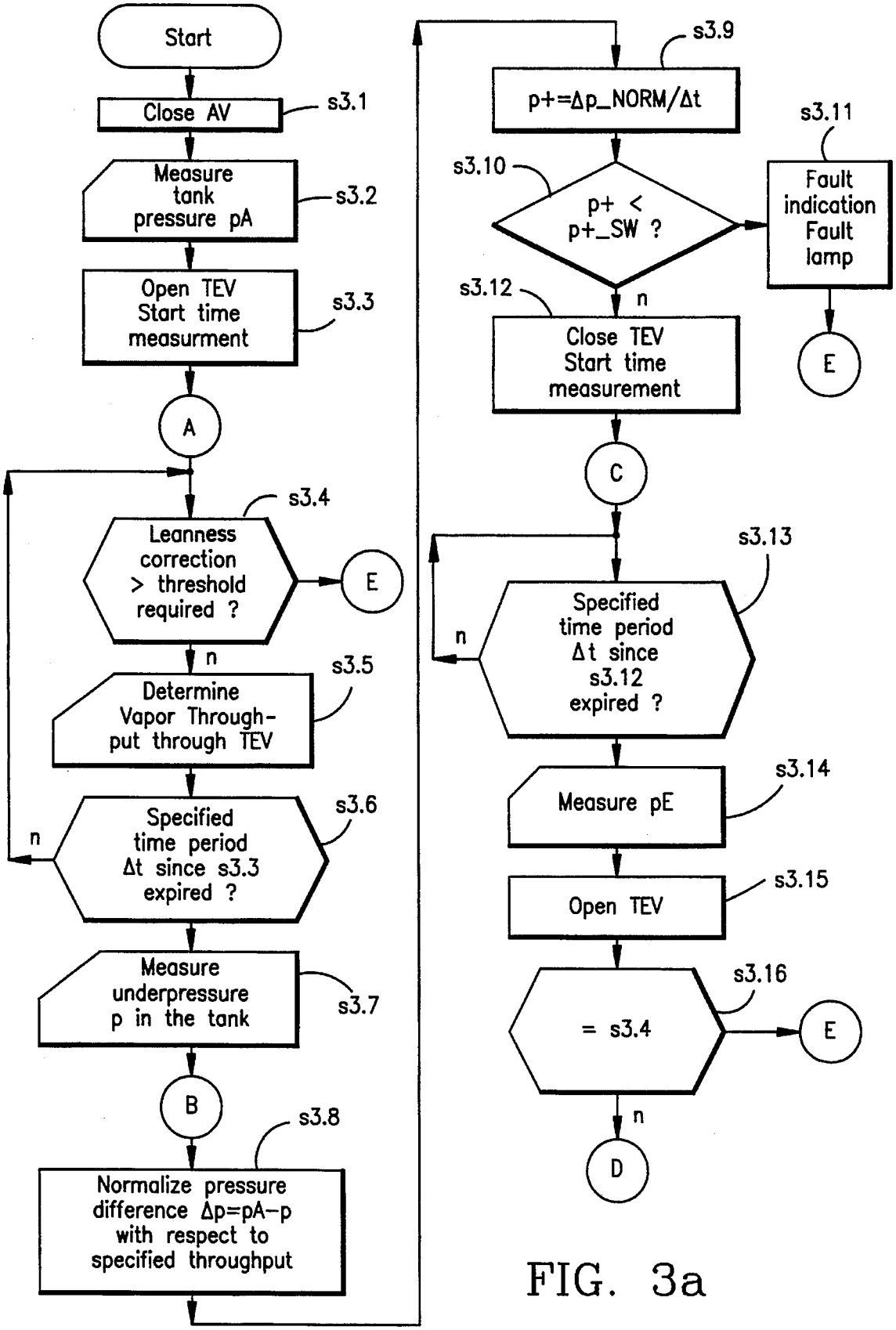
FIGS. 3*a* and 3*b* is a flowchart to explain a method for checking the operability of a tank-venting system; and, FIGS. 4 and 5 are component flowcharts relating to variations in the sequence according to FIGS. 3*a* and 3*b*.
Figure 3B:
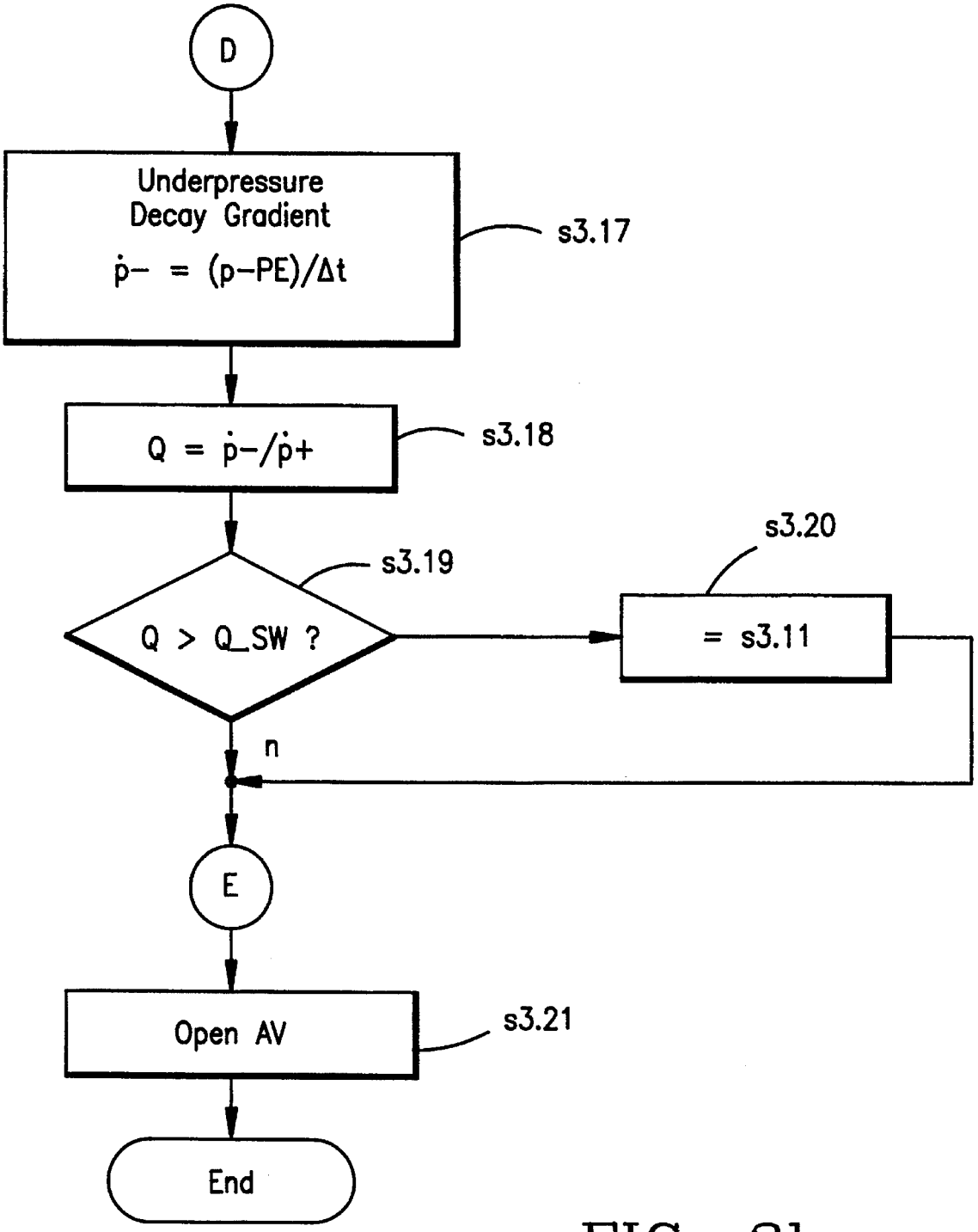

The method according to FIG. 3 uses signals from the differential pressure sensor 11. This sensor can only indicate significant changes in the underpressure after the opening of the tank-venting valve TEV if the underpressure prevailing in the intake pipe 16 is of high magnitude and the tank-venting valve can be opened relatively wide without influencing the fuel/air balance of the internal combustion engine 17 in a manner which could no longer be eliminated rapidly and reliably by the lambda controller 22. These conditions are fulfilled in the case of a fuel which does not vaporize much, particularly during idling. Account should furthermore be taken of the fact that the method described below provides particularly good results when the fuel in the tank vaporizes very little during the measurement. This is the case, in particular, when there is virtually no movement of the fuel in the tank. The probability that such movement will be lacking is high when the internal combustion engine is being operated at idle speed. It is, therefore, assumed in the following that the method of FIGS. 3*a* and 3*b* is only started if idle operation is ascertained beforehand. An additional requirement may be that the vehicle is at standstill. However, it is also possible to permit operation of the engine at medium load, where there is likewise a good pumping effect provided by the tank-venting valve TEV, and to check that the condition of little movement of the tank content is satisfied by evaluating the signals of acceleration sensors such as they are present, for example, in vehicles with controlled suspension systems.

At the beginning of the method of FIGS. 3*a* and 3*b*, the shut-off valve AV is closed (step s3.1) and the differential pressure pA between the pressure in the tank and the ambient pressure is measured (step s3.2). The tank-venting valve TEV is then opened (step s3.3), whereafter a time-measuring loop follows with steps s3.4 to s3.6. In step s3.4, a check is made as to whether a leanness correction beyond a leanness correction threshold is required. If this is the case, a sequence starting at a mark E is reached, this sequence being described in greater detail below. Otherwise, the vapor throughput through the tank-venting valve is determined (step s3.5) and an inquiry takes place as to whether a pregiven time span At has passed since the opening of the tank-venting valve (step s3.6). If the time span has not yet elapsed, steps s3.4 to s3.6 are run through again. Otherwise, the pressure p in the tank is measured (step s3.7) and the difference $\Delta p = pA - p$ between the differential pressures pA and p at the beginning and end of the time span $\Delta t$ is calculated (step s3.8). This pressure difference is normalized with respect to a pregiven throughput through the tank-venting valve (likewise step s3.8) in order to obtain a normalized pressure difference $\Delta p_NORM$. If the cumulative vapor throughput after repeated runs through step s3.5 is smaller than the pregiven throughput, the measured pressure difference is increased accordingly and, otherwise, reduced accordingly, this being done in each case by multiplying the measured pressure difference by the quotient of pregiven and cumulative throughput. It is noted that the vapor throughput per unit time is determined with the aid of: the pulse-duty factor for the tank-venting valve as pregiven by the sequence controller 19; the underpressure in the intake pipe 16; and a characteristic field which describes the relationship between pressure, pulse-duty factor and vapor throughput. In this connection, the underpressure in the intake pipe 16 is either measured by means of an appropriate sensor or determined from the speed of the engine 17 and the position of the throttle flap 28.

The normalized pressure difference $\Delta p_NORM$ is used in determining the underpressure build-up gradient, given by $\Delta p_NORM/\Delta t$ (step s3.9), whereupon a comparison with a threshold value $\dot{p}+_SW$ is carried out (step s3.10). If the threshold value is not reached, then a fault indication is emitted in a step s3.11 and a fault lamp is illuminated. Mark E is then reached again.

If a decision on the operability of the system is not yet possible on the basis of the comparison of build-up gradients in accordance with step s3.10, then the tank-venting valve is closed in a step s3.12 and a new time measurement is started. As soon as a pregiven time span $\Delta t$ has elapsed since the closing of the tank-venting valve (step s3.13), the underpressure pE in the tank is measured (step s3.14) and the tank-venting valve is opened (step s3.15) in order to be able to perform a leanness correction check (step s3.16) corresponding to the check in step s3.4, in which, therefore, either the mark E is reached or the method is continued if the required correction lies below the threshold. If the method is continued, the decay gradient $\dot{p}-=(p-pE)/\Delta t$ is determined (step s3.17) and the quotient of decay gradient/build-up gradient is calculated (step s3.18). If the comparison of this quotient with a quotient threshold value (step s3.19) shows that this threshold value has been exceeded, a step s3.20 follows, which corresponds to the fault indication step s3.14. Otherwise, a step s3.21 is reached via the mark E (already mentioned several times) in which step the shut-off valve is opened whereupon the end of the method is reached.

Instead of the quotient formed as described above, it is also possible to use the reciprocal of this quotient, in which case the system is evaluated as non-operative if the quotient is smaller than a threshold value. Instead of the quotient, it is also possible, for example, to use the absolute value of the difference between the (absolute) gradients (in terms of magnitude). Other modifications are explained with reference to FIGS. 4 to 6.

Figure 4:
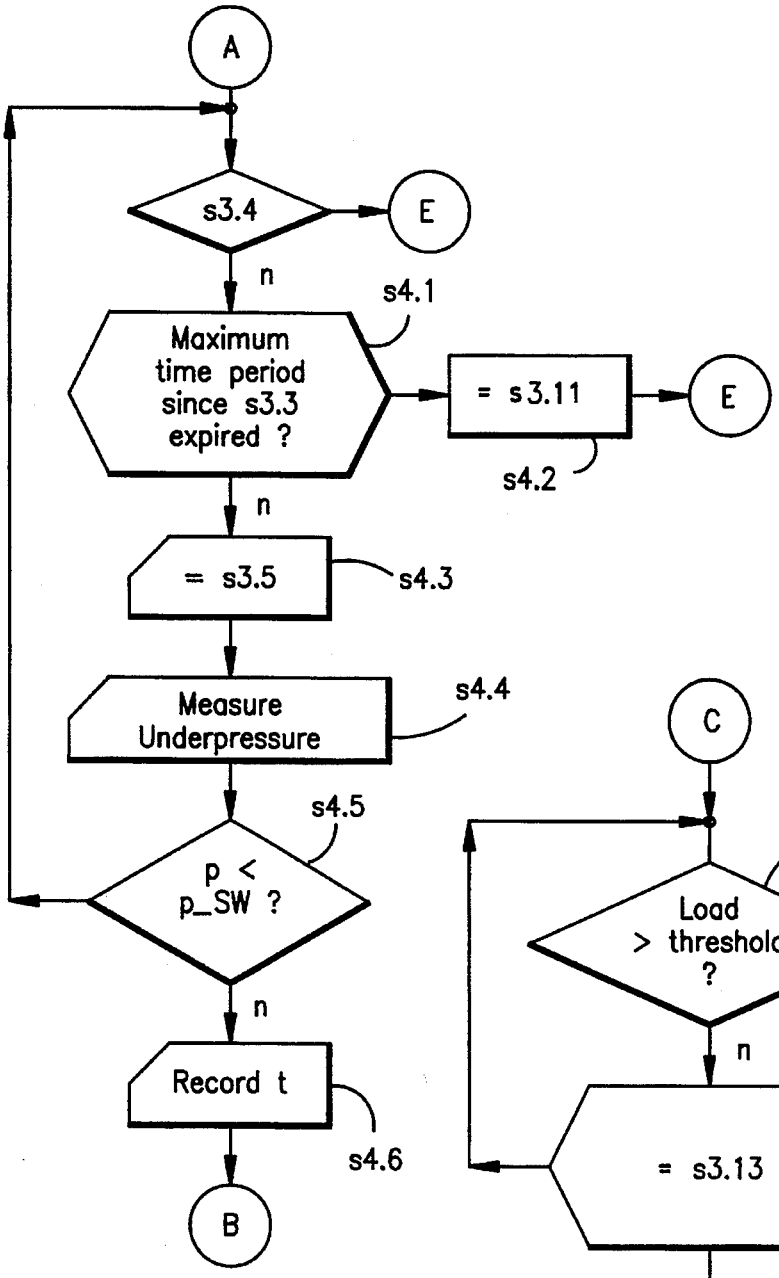

The sequence in accordance with FIG. 4 is to be carried out between marks A and B in the sequence of FIGS. 3*a* and 3*b* in lieu of the partial sequence shown in FIGS. 3*a* and 3*b*. Its purpose is to use as short as possible a time span instead of a pregiven time span. For this purpose, a check is made in a step s4.1 as to whether a maximum time span has elapsed since the opening of the tank-venting valve. This time span is chosen so that, provided the system is leak-tight, a threshold pressure p_SW of, for example, −15 hPa can be reached within the time span even when the tank is empty. If it is ascertained that the time span has elapsed, a fault indication step s4.2 takes place, which corresponds to step s3.11. Otherwise, there follows a step s4.3, in which the vapor throughput is determined in a manner corresponding to step s3.5. The actual differential pressure p in the tank is then measured (step s4.4) and the measured value is compared with the above-mentioned threshold value p_SW (step s4.5). If this threshold value has not yet been reached, the sequence is repeated from step s4.1, while otherwise, the time span $\Delta t$ since the beginning of the opening of the tank-venting valve in step s3.3 is detected in a step s4.6. Then the method follows in accordance with FIGS. 3*a* and 3*b* from step s3.8.

Figure 5:
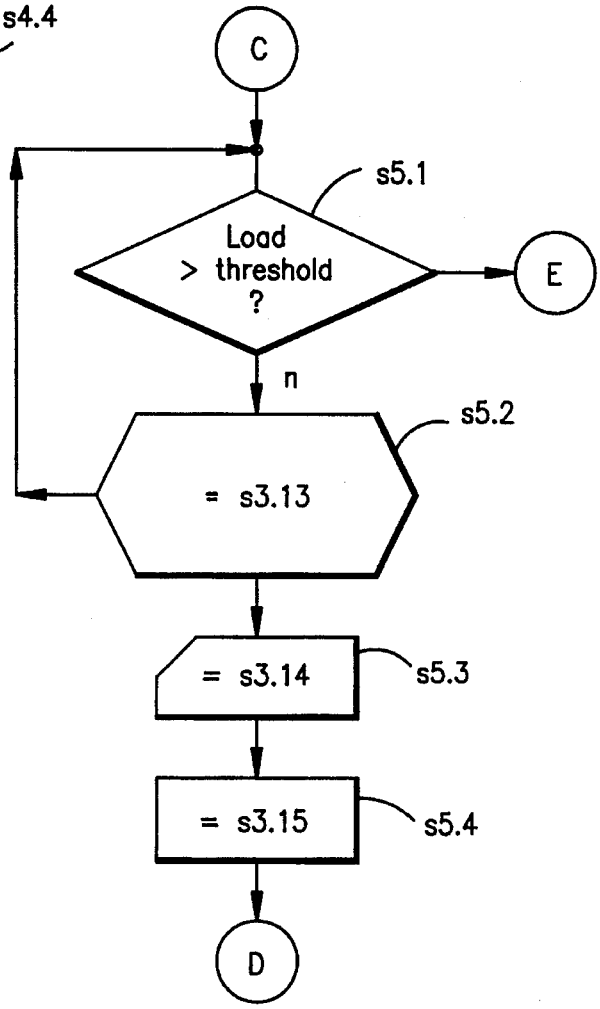

The variant in accordance with FIG. 5 replaces with a single step s5.1 the check in step s3.16, which serves to ascertain whether the measurements can be used for the determination of the decay gradient. For this purpose, a check is made in the above-mentioned step s5.1 as to whether the load on the engine 17 is above a threshold. If this is the case, it is assumed that the vehicle is moving. From this, it is concluded that the contents of the tank are moving and therefore vaporizing and it thus appears advisable to terminate the checking sequence. The mark E is therefore reached. Otherwise, steps s5.2 to s5.4 follow, which correspond to steps s3.13 to s3.15, which are then followed by step s3.17 due to the elimination of step s3.16.

In the description of the fault indication step s3.11, it was stated that the fault indication takes place when a fault is ascertained for the first time. In fault processing in electronic engine systems, however, generally a fault is emitted only if it has occurred several times within a pregiven number of checking sequences. However, such details are not important here.

We claim:

1. A method for checking the operability of a tank-venting system in a vehicle having an internal combustion engine, the tank-venting system including a tank with a tank-pressure sensor, an adsorption filter connected to the tank via a tank-connecting line, and a tank-venting valve which is connected to the adsorption filter via a valve line, in which system the adsorption filter has a venting line which can be closed by means of a shut-off valve, the method comprising the steps of:

closing the shut-off valve;

opening the tank-venting valve;

determining a build-up gradient ($\dot{p}+$) of the underpressure building up in the tank;

closing the tank-venting valve;

determining a decay gradient ($\dot{p}-$) of the decaying underpressure in the tank;

mathematically combining the build-up and decay gradients so as to cause the fill level to have as little effect as possible on the evaluation variable (Q) formed by means of the combination; and, comparing the value of the evaluation variable to a threshold value (Q_SW) and determining the system as non-operative if the value of the evaluation variable and the threshold value satisfy a pregiven relationship.

2. The method of claim 1, comprising the step of forming the evaluation variable by a quotient which includes the build-up and the decay gradients.

3. The method of claim 1, comprising the further steps of:

checking as to whether a lambda controller coacting with the internal combustion engine has to perform a leanness correction greater than a threshold leanness correction in the time span during which the tank-venting valve is open; and, terminating the checking sequence without a result if the detected leanness correction is greater than the threshold leanness correction.

4. The method of claim 1, comprising the further steps of:

checking as to whether a lambda controller coacting with the internal combustion engine has to carry out a leanness correction greater than a threshold leanness correction in the time span during which the tank-venting valve is open; and, terminating the checking sequence with the result that the system is not leak-tight if the detected leanness correction is less than the threshold leanness correction and the build-up gradient is less than a threshold value ($\dot{p}+<\dot{p}+_SW$).

5. The method of claim 1, comprising the further steps of:

making a plurality of pressure measurements to determine the decay gradient;

after the last pressure measurement is made, opening the tank-venting valve is opened and checking whether a lambda controller coacting with the internal combustion engine has to carry out a leanness correction greater than a threshold leanness correction; and, terminating the checking sequence without a result if the detected leanness correction is greater than the threshold leanness correction.

6. The method of claim 1, comprising the further steps of:

at the closing time point of the tank-venting valve, checking at least one operating parameter of the vehicle with the measured values of this operating parameter indicating whether the vehicle and therefore the contents of the tank are in motion; and, terminating the checking sequence without a result if the measured value of the operating parameter is higher than a pregiven threshold value.

7. The method of claim 1, comprising the further steps of:

determining the vapor throughput through the tank-venting valve in the time span during which said tank-venting valve is open; and, normalizing the build-up gradient with respect to a pregiven vapor throughput.

8. An arrangement for checking the operability of a tank-venting system in a vehicle having an internal combustion engine, the tank-venting system including a tank with a tank-pressure sensor, an adsorption filter connected to the tank via a tank-connecting line, and a tank-venting valve which is connected to the adsorption filter via a valve line, in which system the adsorption filter has a venting line which can be closed by means of a shut-off valve, the arrangement comprising:

a sequence controller for driving the shut-off valve and the tank-venting valve;

gradient determination means for determining the build-up gradient of the underpressure which builds up in the tank when the shut-off valve is closed and the tank-venting valve is open and for determining the decay gradient of the decaying underpressure in the tank after a closure of the tank-venting valve;

evaluation-variable calculation means for mathematically combining the build-up and decay gradients so as to cause the fill level to influence an evaluation variable (Q) formed by the combination of said build-up and decay gradients as little as possible;

comparison means for comparing the value of the evaluation variable to a threshold value (Q_SW) to evaluate the system as non-operative if the value of the evaluation variable and the threshold value satisfy a pregiven relationship; and, comparison/evaluation means for comparing the value of the evaluation variable to a threshold value and for evaluating the system as non-operative if the value of the evaluation variable and the threshold value satisfy a pregiven relationship.

* * * * *

UNITED STATES PATENT AND TRADEMARK OFFICE

CERTIFICATE OF CORRECTION

PATENT NO. : 5,463,998

DATED : November 7, 1995

INVENTOR(S) : Helmut Denz and Andreas Blumenstock

It is certified that error appears in the above-indentified patent and that said Letters Patent is hereby corrected as shown below:

Title page, Abstract line 12 delete "(p+)" and substitute -- ($\dot{p}$+) -- therefor.

Title page, Abstract line 15 delete "(p-)" and substitute -- ($\dot{p}$-) -- therefor.

In column 4, line 58: delete "FIG. 3" and substitute -- FIGS. 3a and 3b -- therefor.

In column 5, line 31: delete "At" and substitute -- $\Delta$t -- therefor.

In column 6, line 8: delete "p-=(p-pE)/$\Delta$t" and substitute -- $\dot{p}$-=(p-pE)/$\Delta$t -- therefor.

Signed and Sealed this

Twenty-fourth Day of September, 1996

*Attest:*

Bruce Lehman

BRUCE LEHMAN

*Attesting Officer*

*Commissioner of Patents and Trademarks*